US007875128B2

(12) United States Patent
Kuroda et al.

(10) Patent No.: US 7,875,128 B2
(45) Date of Patent: Jan. 25, 2011

(54) METHOD FOR MANUFACTURING A STAINLESS STEEL PRODUCT AND A STAINLESS STEEL PRODUCT MANUFACTURED BY THE METHOD

(75) Inventors: Daisuke Kuroda, Tsukuha (JP); Shinichi Yanadori, Niigata-ken (JP); Mitsuo Watanabe, Niigata-ken (JP); Kazuma Miura, Niigata-ken (JP)

(73) Assignees: National Institute for Materials Science, Tsukuba-shi (JP); Myodo Metal Co., Ltd., Tsubame-shi (JP)

( * ) Notice: Subject to any disclaimer, the term of this patent is extended or adjusted under 35 U.S.C. 154(b) by 772 days.

(21) Appl. No.: 11/738,075

(22) Filed: Apr. 20, 2007

(65) Prior Publication Data

US 2007/0186999 A1 Aug. 16, 2007

(51) Int. Cl.
*C23C 8/26* (2006.01)
*C22C 38/18* (2006.01)

(52) U.S. Cl. ..... 148/232; 148/230; 420/34

(58) Field of Classification Search ..... 148/230, 148/232; 420/34

See application file for complete search history.

(56) References Cited

U.S. PATENT DOCUMENTS 3,118,795 A * 1/1964 Kolbe et al. ..... 148/103
7,229,506 B2 * 6/2007 Giordani et al. ..... 134/41

FOREIGN PATENT DOCUMENTS

JP 05-311336 A 11/1993
JP 07-188733 A 7/1995
JP 2000-008145 A 1/2000
JP 2004-068115 A 3/2004

OTHER PUBLICATIONS

Machine Translation of Kuroda et al. (JP 2004-068115).*

* cited by examiner

*Primary Examiner*—Roy King
*Assistant Examiner*—Jessee R. Roe
(74) *Attorney, Agent, or Firm*—McDermott Will & Emery LLP

(57) ABSTRACT

A Ni-free stainless steel product excellent in workability and corrosion resistance and a method for manufacturing such stainless steel product. A ferritic stainless steel product containing 18 to 24% by mass of Cr and 0 to 4% by mass of Mo is brought into contact with an inert gas containing a nitrogen gas at 800 degrees C. or above to subject it to nitrogen absorption treatment so that the product is austenitized partially or wholly to obtain such nickel-free product.

5 Claims, 5 Drawing Sheets

γ: Austenite
α: Ferrite

METHOD FOR MANUFACTURING A STAINLESS STEEL PRODUCT AND A STAINLESS STEEL PRODUCT MANUFACTURED BY THE METHOD

BACKGROUND OF THE INVENTION

1. Field of the Invention

The present invention relates to a method for manufacturing a stainless steel product and a stainless steel product manufactured by the method.

2. Related Prior Arts

Conventionally, in order to produce a stainless steel product with good workability and corrosion resistance, Japanese Un-Examined Patent Application Publication No. 2004-68115, for example, proposes a method of manufacturing a stainless steel product by nitrogen absorption treatment, comprising the steps of bringing a bulk product of a ferritic stainless steel having been formed into a desired shape through melting and machining, into contact with an inert gas containing nitrogen gas at 800 degrees C. or above, and austenitizing the product either wholly or partially to form a two-phase structure comprised of ferrite and austenite.

Further, Japanese Un-Examined Patent Application Publication No. 7-188733, for example, proposes a thermal treatment process for improving friction resistance due to the structural components of ferrite and martensite being made austenitic in the surface region of stainless ferritic-austenitic duplex steel X 2CrNiMoN2253 through the nitrogen enrichment at 1,000 to 1,200 degrees C.

Furthermore, Japanese Un-Examined Patent Application Publication No. 5-311336, for example, proposes a chromium-based stainless steel plate comprised of 13.0 to 20.0% by weight of Cr, 0.1 or lower % by weight of C and 0.1 or lower % by weight of N, and Fe and unavoidable impurities as the remainder, said stainless steel plate including a nitrogen enriched layer.

As is apparent from the foregoing, the foregoing prior art documents propose austenitizing through nitrogen absorption treatment. Specifically, according to the technique disclosed by Japanese Un-Examined Patent Application Publication No. 2004-68115, it is possible to produce a stainless steel product with good workability and corrosion resistance. According to these prior arts, however, there still remain some problems to be solved for actual mass production, such as improvement of nitrogen absorption efficiency and control of grain coarsening in the nitrogen absorption process.

In recent years, Ni-free ferritic stainless steel has been used as a material for a side member of a watch or the like that is to be directly contacted by a human body, as is proposed in Japanese Un-Examined Patent Application Publication No. 2000-8145. Ferritic stainless steel, however, is inferior to austenitic stainless steel in respect of corrosion resistance and strength.

SUMMARY OF THE INVENTION

It is, therefore, an object of the present invention to provide a Ni-free stainless steel product that is excellent in workability and corrosion resistance. It is another object of the present invention to provide a method for manufacturing such stainless steel product.

The inventors of the present invention have been dedicated to the study for further improvement of corrosion resistance and production efficiency in austenitic stainless steel having good mechanical strength and corrosion resistance, in view of the problems associated with the conventional austenitic stainless steel, such as addition of nickel, expensiveness of products manufactured by subjecting a melted material of ferritic stainless steel to nitrogen absorption treatment, formation of nitrides due to partial solid insolubility of nitrogen, and grain coarsening associated with heating. Such dedicated study has led the inventors to the present invention.

According to a first aspect of the present invention, there is provided a method for manufacturing a stainless steel product, which comprises the steps of:

bringing a ferritic stainless steel product containing 18 to 24% by mass of Cr and 0 to 4% by mass of Mo into contact with an inert gas containing a nitrogen gas at 800 degrees C. or above to subject it to nitrogen absorption treatment; and austenitizing either the whole or a part of said product to make the product nickel-free.

According to a second aspect of the present invention, there is provided the method for manufacturing a stainless steel product according to the first aspect, wherein said product is austenitized completely.

According to a third aspect of the present invention, there is provided the method for manufacturing a stainless steel product according to the first aspect, further comprising a step of removing a surface oxide film before or after said nitrogen absorption treatment.

According to a fourth aspect of the present invention, there is provided the method for manufacturing a stainless steel product according to the third aspect, wherein at least one of said steps for removing a surface oxide film is reduction treatment.

According to a fifth aspect of the present invention, there is provided the method for manufacturing a stainless steel product according to the third aspect, wherein said steps for removing a surface oxide film are reduction treatments, and the reduction treatment prior to said nitrogen absorption treatment is carried out in the presence of an inert gas containing a reducing gas at 800 to 1000 degrees C., said nitrogen absorption treatment is carried out at 1000 to 1200 degrees C., and the reduction treatment after said nitrogen absorption treatment is carried out at 800 to 1000 degrees C., respectively.

According to a sixth aspect of the present invention, there is provided the method for manufacturing a stainless steel product according to any of the preceding aspects, further comprising a rolling step prior to said nitrogen absorption treatment.

According to a seventh aspect of the present invention, there is provided a stainless steel product produced by the method of any of the preceding aspects, wherein said stainless steel product contains 18 to 24% by mass of Cr, 0 to 4% by mass of Mo and 0.3 to 1.5% by mass of N.

According to an eighth aspect of the present invention, there is provided the stainless steel product according to the seventh aspect, wherein said stainless steel product is a primary product, such as a plate material, a rod material and a wire material.

According to the first aspect of the present invention, a ferritic stainless steel product is brought into contact with an inert gas containing a nitrogen gas at 800 degrees C. or above to thereby treat it with nitrogen absorption treatment; the whole part or only a part of the product can be austenitized, thus making it possible to provide a Ni-free stainless steel product excellent in strength and corrosion resistance.

The ferritic stainless steel product may contain 18 to 24% by mass of Cr, because the more Cr content it contains, the more easily it is enriched with nitrogen during the nitrogen absorption treatment, thus making contributions to the improvement of mechanical attributes and corrosion resistance. If the Cr content is less than 18%, the nitrogen absorption treatment will take a longer time, making it difficult to obtain a single-phase austenitic structure by the nitrogen absorption treatment. On the other hand, the maximum Cr content capable of keeping such single-phase austenitic structure is 24%, as found out by the present inventors, and thus the foregoing range of from 18 to 24% was determined.

Further, the ferritic stainless steel product may contain 0 to 4% by mass of Mo, because adding Mo not only facilitates absorption of nitrogen but improves the stress corrosion cracking (SCC), yet adding 4% or more by mass of Mo makes a rolling process difficult, and thus the foregoing range of 0 to 4% was determined in view of processability as well.

According to the second aspect of the present invention, it is possible to manufacture a non-conventional stainless steel product that is wholly austenitized.

According to the third aspect of the present invention, nitrogen is allowed to smoothly diffuse from the surface into the inside during the nitrogen absorption treatment owing to the oxide film removing step performed prior to the nitrogen absorption treatment, because the presence of oxide film hinders diffusion of nitrogen. Further, owing to the oxide film removing step performed after the nitrogen absorption treatment, it is possible to remove oxide films from the product that underwent nitrogen absorption treatment.

According to the fourth aspect of the present invention, oxide film can be removed in a preferable manner, by using reduction treatment.

According to the fifth aspect of the present invention, the reduction treatments before and after the nitrogen absorption treatment are carried out in the presence of an inert gas containing a reducing gas such as hydrogen gas at 800 to 1000 degrees C., and thus surface cleaning is performed so that the reduction treatments can be carried out with the grain coarsening being suppressed.

Further, the nitrogen absorption treatment is carried out in a range of from 1000 to 1200 degrees C., and thus nitrogen can be absorbed efficiently. In other words, the above range of temperature was chosen because ambient temperature lower than 1000 degrees C. will make nitrogen less absorbable but ambient temperature higher than 1200 degrees C. will cause rapid grain coarsening, leading to the likelihood of reduction of corrosion resistance, strength and toughness. In addition, nitrogen can be allowed to efficiently diffuse during the nitrogen absorption treatment, by performing the nitrogen absorption treatment at the ambient temperature higher than that for the preliminary reduction treatment.

According to the sixth aspect of the present invention, metal structure is collapsed by rolling, thus facilitating the miniaturization of grain size, restraining the grain coarsening. Further, the whole part of the stainless steel product can be austenitized in a comparatively short time, by repeating the rolling step and nitrogen absorption treatment.

According to the seventh aspect of the present invention, the stainless steel product contains 0.3 to 1.5% by mass of N, thus improving toughness and strength thereof, enabling the improvement of anti-corrosion property under NOx environment or the like.

According to the eighth aspect of the present invention, various kinds of Ni-free primary products can be obtained.

BRIEF DESCRIPTION OF THE ATTACHED DRAWINGS

BEST MODE FOR CARRYING OUT THE INVENTION

Next is a detailed description of preferred embodiments of the present invention with reference to the accompanying drawings. It should be noted that the embodiments explained hereinafter are not to be construed as limiting the invention, and that not all the structural features described hereinbelow are requirements for the present invention.

First Embodiment

Next is a description of a method for producing a stainless steel product in accordance with a first embodiment of the present invention with reference to FIGS. 1 to 5.

The nitrogen absorption treatment of the present invention is related to a so-called solid-phase nitrogen absorption method by which a larger amount of nitrogen can be added than by conventional melting method, due to the solid solubility limit of nitrogen being remarkably large in a solid state than in a molten state.

According to the solid-phase nitrogen absorption method of the present invention, a stainless steel product is austenite-structured by allowing nitrogen to form a solid solution thoroughly, which differs largely from other nitrogen treatment performed for the purpose of surface hardening. Further, according to the method for manufacturing a stainless steel product by nitrogen absorption treatment of the present invention, a subject to which nitrogen is to be added is a melt product of ferritic stainless steel (inclusive of primary product), and thus it is easy to process as compared to austenitic stainless steel product, enabling a product of a desired shape to be obtained. Furthermore, restraints in device scale and in formability in powder metallurgy process are eliminated, and the aforesaid problem of melt products in respect of mechanical reliability are solved.

Figure 1:
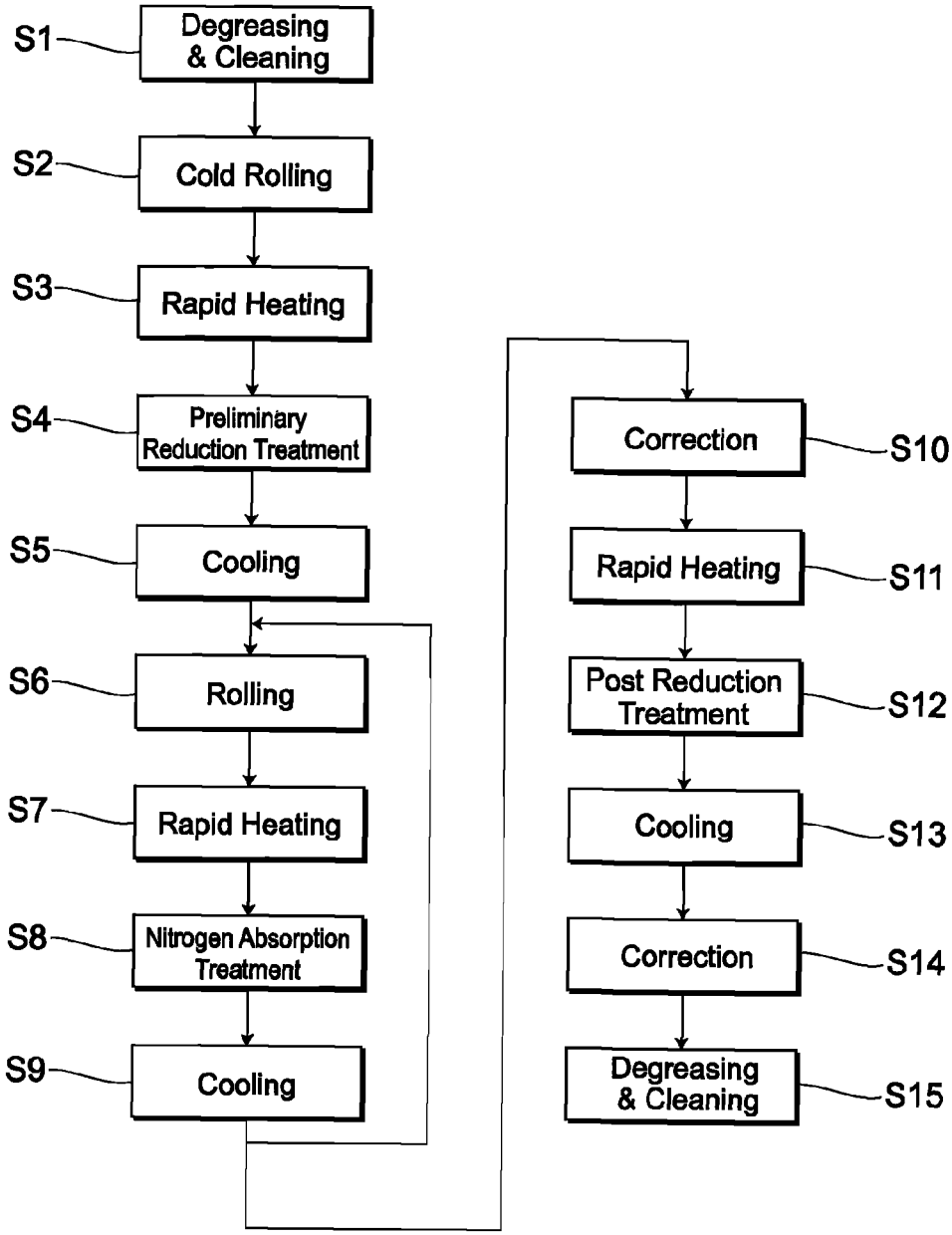
FIG. 1 is a block diagram showing a method for manufacturing a stainless steel product, according to a first embodiment of the present invention.
Figure 2:
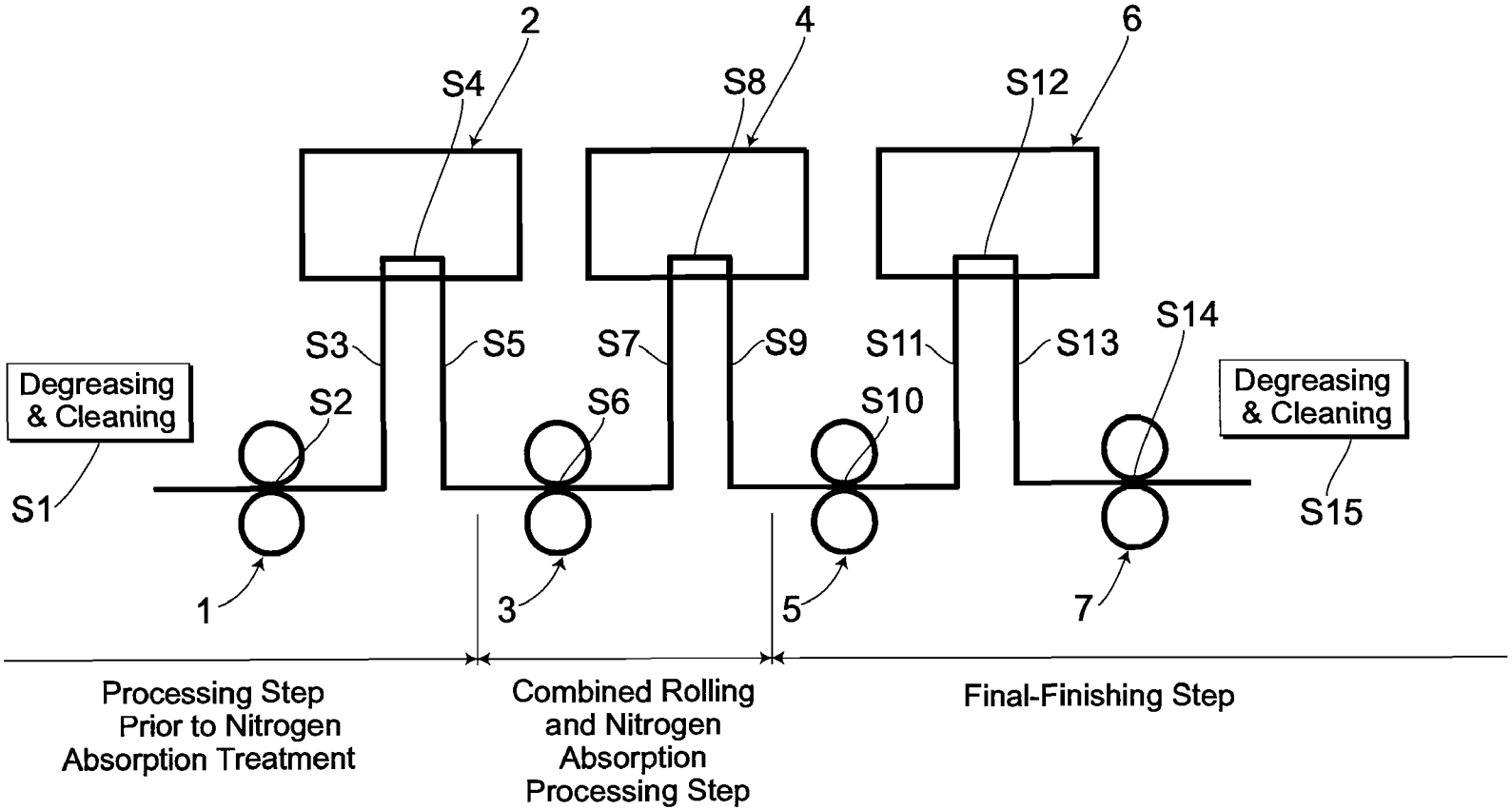
FIG. 2 is an explanatory diagram showing the manufacturing method of FIG. 1.

Next is a detailed description of a manufacturing method of the invention with reference to FIGS. 1, 2, etc. In this example, a plate material product made from ferritic stainless steel is discussed as an example, in which the ferritic stainless steel is comprised of 18 to 24% by mass of Cr, 0 to 4% by mass of Mo and the remainder comprised of Fe and unavoidable impurities.

After fully degreasing and cleaning an unprocessed plate material with acetone (S1), as a preliminary step prior to the nitrogen absorption treatment, the material is cold-rolled, using a rolling roll (S2), and then subjected to rapid heating (S3) until it reaches reduction temperature within a batch electric furnace 2 serving as a prior reduction treatment equipment, and thus a preliminary reduction treatment (S4) is performed in a range of from 800 to 1000 degrees C. as reduction temperature and under the inert gas atmosphere containing hydrogen gas as reductive gas.

Nitrogen, for example, is used for such inert gas, with the proportion of hydrogen contained in the inert gas being 10% to 100%, while reduction time is set at about 10 min to 1 hr, removing impurities, such as oxide films on the surface of the plate material (product) and thus cleaning the same. After the preliminary reduction treatment (S4), cooling to normal temperature is performed under the inert gas atmosphere containing nitrogen inside the batch electric furnace 2 (S5) Since the surface of the plate material is cleaned this way, the subsequent nitrogen diffuse absorption step can be performed smoothly.

In the meantime, in said rapid heating step (S3), temperature is raised from normal temperature at an increasing rate of 1 to 1000 degrees C./sec. while in the cooling step (S4), temperature is lowered from reduction temperature at a decreasing rate of 100-1000 degrees C./sec., in which case, cooling can be performed by replacing the inert gas atmosphere containing nitrogen inside the batch electric furnace 2.

Then, the plate material is cold-rolled (S6), using the rolling roll 3 after said cooling step (S5) so that it is formed to a desired thickness prior to the nitrogen absorption treatment. For example, if the desired thickness prior to the nitrogen absorption treatment is 2 mm and the thickness of the plate material prior to the cold rolling (S2) is 6 mm, then it may be rolled from 6 mm thickness to 2 mm thickness through the said cold-rolling steps (S2) and (S4), whereby the metal structure of the plate material is collapsed, thus miniaturizing the grain, and suppressing grain coarsening.

After the cold rolling step (S6), the plate material of about 2 mm thickness is subjected to rapid heating (S7) until it reaches treatment temperature within a batch electric furnace 4 serving as a nitrogen absorption treatment equipment, and thus a nitrogen absorption treatment (S8) is performed with the batch electric furnace 4 being brought in contact with nitrogen at the treatment temperature ranging from 1000 to 1200 degrees C.

Thus way, nitrogen can be absorbed efficiently by performing the nitrogen absorption treatment (S8) at 1000 to 1200 degrees C. In other words, the above range of temperature of 1000 to 1200 degrees C. is preferable because ambient temperature lower than 1000 degrees C. will make nitrogen less absorbable by the plate material but ambient temperature higher than 1200 degrees C. will cause rapid grain coarsening, leading to the likelihood of deterioration of corrosion resistance, strength and toughness.

In addition, nitrogen can be allowed to efficiently diffuse during the nitrogen absorption treatment (S8), by performing the nitrogen absorption treatment (S8) at the ambient temperature higher than that for the preliminary reduction treatment.

After the nitrogen absorption treatment (S8), cooling (S9) is performed until it reaches normal temperature under the nitrogen gas atmosphere inside the batch electric furnace 4. In the meantime, in said rapid heating step (S7), temperature is raised from normal temperature at a rate of 1 to 1200 degrees C./sec. while in the cooling step (S9), temperature is lowered from the treatment temperature at a rate of 100-1200 degrees C./sec., in which case, cooling can be performed by replacing the nitrogen gas inside the batch electric furnace 4. It should be noted that in the nitrogen absorption treatment (S8), the plate material is allowed to contact nitrogen either at normal pressures (1 atmosphere) or higher pressures.

Through the nitrogen absorption treatment (S8), it is possible to obtain a plate material which is austenitized at a surface side and is ferritic stainless steel at the inside thereof. In the case of manufacturing a plate material of such two-phase structure, a correction step (S10) is performed as a final finish step after the cooling step (S9).

On the other hand, in the case of austenitizing the product wholly, the manufacture flow returns to the cold-rolling step (S6) after the cooling step (S9), and thus "combined rolling and nitrogen absorption treatment process" consisting of the cooling step (S6), the rapid heating step (S7), the nitrogen absorption treatment (S8) and the cooling step (S9) is repeated by the necessary number of times. The following Table 1 shows a relationship between the number of combined rolling and nitrogen absorption processes, thickness of the plate material and processing time. Namely, it takes 60 minutes for the 2 mm thick plate material to be processed in the nitrogen absorption treatment. Then, the plate material is processed so as to be thinned from 2 mm to 1 mm by the second cold rolling step (S6). In this way, the plate material is processed so as to be thinned by about 45 to 65% per every cold rolling step (S6).

TABLE 1

| Number of Rolling and Nitrogen Absorption Processes | Sheet Thickness or Diameter (mm) | Processing Time (min.) |
|---|---|---|
| 1 | 2.0 | 60 |
| 2 | 1.0 | 60 |
| 3 | 0.55 | 45 |
| 4 | 0.3 | 30 |
| 5 | 0.19 | 20 |

By repeating the cold-rolling (S6) and the nitrogen absorption treatment (S8) in this way, the target amount of nitrogen can be put into the plate material, and the thickness of austenite at the surface side can also be set up suitably. In the present example, it was possible to austenitize the plate material product wholly with the thickness thereof being 0.3 mm. In the meantime, the wording "diameter" in the table 1 shows a case where the product is a round bar.

After the "combined rolling and nitrogen absorption treatment process", the manufacture process then proceeds to the "final finish step" where the correction of the plate material is performed using the rolling roll 5 (S10), thereby removing distortions or the like, forming the product to a preset size or below. Then, rapid heating (S11) of the plate material is carried out until it reaches the reduction temperature within a batch electric furnace 6 serving as a post reduction treatment unit, thus performing the reduction treatment (S12) with the inside of the batch electric furnace 6 being heated at 800-1000 degrees C. under the hydrogen gas atmosphere serving as the reductive gas.

Then, the reduction time for the reduction treatment (S12) is set at about 10 min to 1 hr, and impurities, such as oxide films on the surface of the plate material as a workpiece, are removed and cleaned off. After the reduction treatment (S12), it is cooled to normal temperature (S13) under the hydrogen gas atmosphere inside the batch electric furnace 6. In addition, in said rapid heating (S11), temperature is raised from normal temperature at the rate of 1-1000 degrees C./sec, while in said cooling step (S14), temperature is lowered from the reduction temperature at the rate of 100-1000 degrees C./sec., in which case, cooling can be performed by replacing the hydrogen gas atmosphere in the batch electric furnace 6.

After heating the plate material at the post reduction treatment (S12) in this way, the plate material is subjected to the correction step, using the rolling roll 7 (S14), and then degreased and cleaned (S15). The reason why only the hydrogen gas is used in the post reduction treatment (S12) is to efficiently remove the surface oxide film formed on the product surface in a short time and to give luminance to the surface of a final product. It should be noted that said preliminary reduction treatment (S4) and post reduction treatment (S12) are the surface oxide film removal steps for removing a surface oxide film.

Next is a description of action and effect resulting from the repeating of said "combined rolling and nitrogen absorption treatment process". A ferritic stainless steel plate containing 24% by mass of Cr and 2% by mass of Mo with the remainder comprised of Fe and unavoidable impurities was austenitized according to the above-mentioned manufacturing method.

Figure 3A:
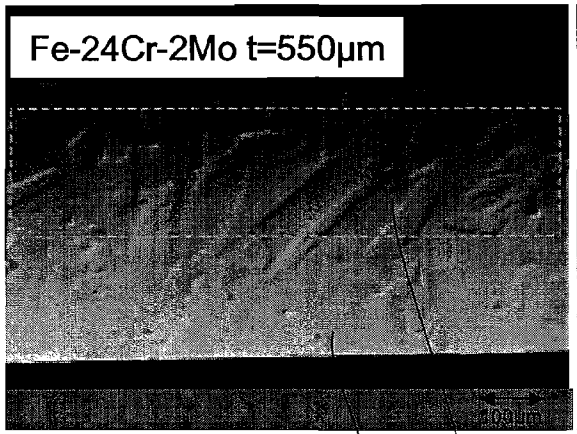
FIG. 3(A) is a micro-photographic representation of a plate material of 550 μm thickness manufactured by the method of FIG. 1, FIG. 3 (B) that of 301 μm, FIG. 3(C) that of 190 μm, respectively.
Figure 3B:
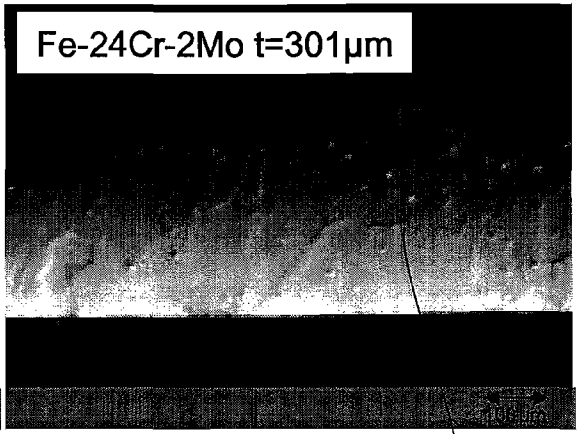
Figure 3C:
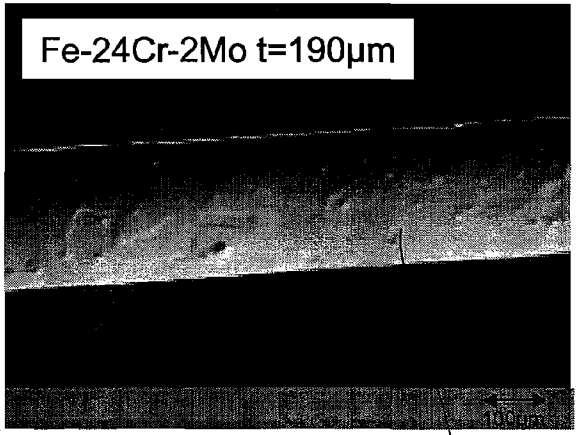

FIG. 3(A) is a micro-photographic representation of the plate material of 550 μm thickness processed thrice according to the method, FIG. 3 (B) that of 301 μm processed four times, FIG. 3(C) that of 190 μm processed five times, respectively.

The 550 μm-thick plate material is austenitized at the surface side while it has a two-phase structure comprising ferrite at the center side. FIGS. 3 (B) and 3(C) show that the plate material is austenitized in the inside thereof as well, and thus the product is austenitized wholly.

Grain coarsening will be unavoidable if the plate material is exposed to high temperature state for a long time in order to secure the absorption of nitrogen through the nitrogen absorption treatment (S8). According to the present invention, however, the cold rolling (S6) and the nitrogen absorption treatment (S8) are repeated, and thus total time required for heating the plate material is shortened, thus enabling the grain coarsening to be suppressed, while facilitating the grain miniaturizing by collapsing the metal structure by the mechanical pressing from the cold rolling (S6), thereby also controlling the grain coarsening.

Moreover, due to nitrogen being diffused and then entering from the surface, the product can be treated with the nitrogen absorption treatment in a shorter time than when the nitrogen absorption treatment is carried out with the thickness thereof retained unchanged, by performing the nitrogen absorption treatment (S8) with the plate material rolled through the rolling step (S6).

Figure 4:
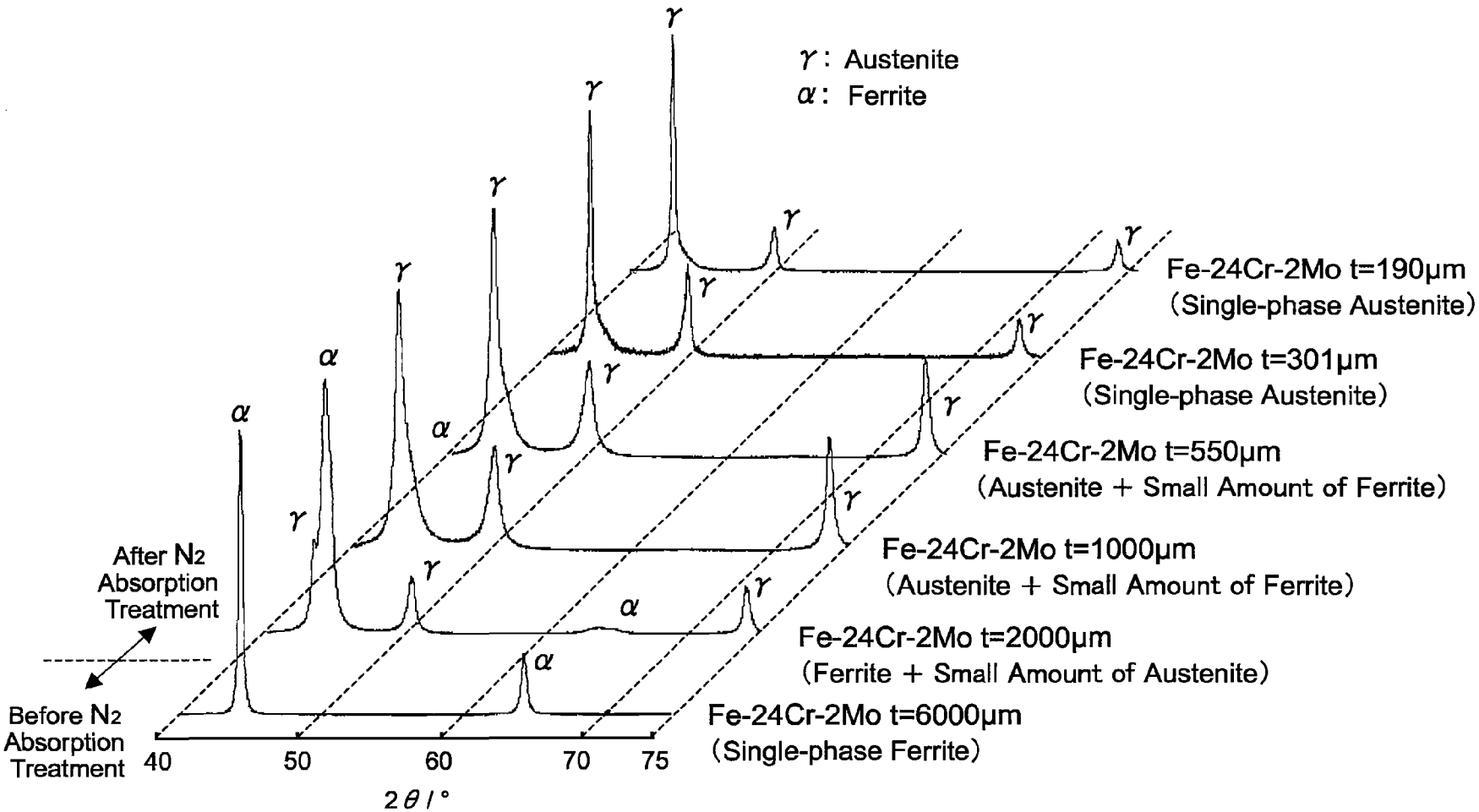
FIG. 4 is a diagram showing an X-ray diffraction pattern thereof.

FIG. 4 shows a result of identification of microstructures of plate materials subjected to different times of "combined rolling and nitrogen absorption treatment" according to the manufacturing method shown in the flow chart of FIG. 1, obtained by using an X ray diffraction apparatus, specifically showing X ray diffraction patterns obtained by using a CuKα tube, changing the angle every 1 degree/min in a range of 20 from 40° to 90°.

As is clearly seen from the drawing, it could be confirmed that after treating a 6 mm-thick ferritic single-phase stainless steel plate material with the nitrogen absorption treatment according to the manufacturing method shown in FIG. 1, 301 μm-thick and 190 μm-thick ones were each tuned into an austenitic single-phase, and thus Ni-free stainless steel products wholly austenitized were obtained.

Figure 5:
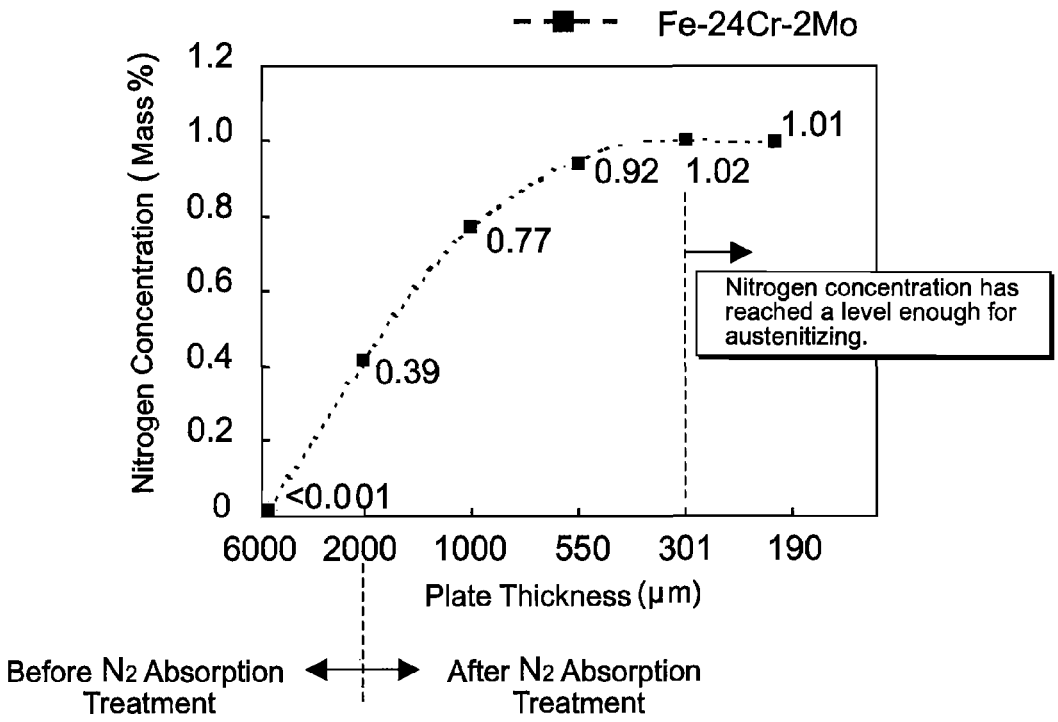
FIG. 5 is a graph showing a nitrogen concentration of the plate member.

FIG. 5 is a graph showing a relationship between the number of "combined rolling and nitrogen absorption treatment processes" and the nitrogen concentration of the plate materials, in which a horizontal scale indicates a thickness of the plate material (μm) and a vertical scale indicates nitrogen concentration (mass %). As shown in the drawing, Fe-24Cr-2Mo (ferritic stainless steel containing 24% by mass of Cr, 2% by mass of Mo and the remainder comprised of Fe and unavoidable impurities) was subjected to the nitrogen absorption treatment (S8) according to the manufacturing method shown in FIG. 1, and the nitrogen concentrations of the plate materials of different thickness were measured. It was revealed from the result of the measurement that the product is austenitized wholly if the nitrogen concentration exceeds 0.95 mass %.

The following Table 2 indicates a result of measurement of mechanical strength of a 6 mm-thick Fe-24Cr-2Mo ferritic stainless steel plate material and a 0.19 mm-thick stainless steel plate material austenitized wholly by performing the "combined and nitrogen absorption treatment process" five times.

TABLE 2

| Thickness (mm) | Vickers Hardness (HV) | 0.2% Yield Strength (MPa) | Maximum Tensile Strength (MPa) | Breaking Elongation (%) |
|---|---|---|---|---|
| 6.00 (*) | 295 | 928 | 934 | 3.3 |
| 0.19 (**) | 303 | 637 | 894 | 16 |

(*) pretreatment thickness
(**) posttreatment thickness

As is shown in the Table 2, the ferritic stainless steel has approximately equal 0.2% yield strength and maximum tensile strength so that it will fracture due to a slight elongation. The product (0.19 mm thick) manufactured according to the method of the present invention, however, indicates 16% breaking elongation, thus showing excellence in mechanical strength against tension.

Next, an experiment was carried out on relationship between the Cr content and the amount of nitrogen that forms a solid solution (amount of nitrogen-solid solution) Comparison experiments were carried out on the following alloys:

Fe-8Cr-2Mo (ferritic stainless steel containing 8% by mass of Cr, 2% by mass of Mo and the remainder comprised of Fe and unavoidable impurities)

Fe-12Cr-2Mo (ferritic stainless steel containing 12% by mass of Cr, 2% by mass of Mo and the remainder comprised of Fe and unavoidable impurities)

Fe-16Cr-2Mo (ferritic stainless steel containing 16% by mass of Cr, 2% by mass of Mo and the remainder comprised of Fe and unavoidable impurities)

Fe-20Cr-2Mo (ferritic stainless steel containing 20% by mass of Cr, 2% by mass of Mo and the remainder comprised of Fe and unavoidable impurities)

Fe-24Cr-2Mo (ferritic stainless steel containing 24% by mass of Cr, 2% by mass of Mo and the remainder comprised of Fe and unavoidable impurities).

From the result of the experiments, it was revealed that the more Cr content the alloy contains, the more nitrogen forms a solid solution. It was also revealed that slight differences in Cr content or in nitrogen absorption treatment temperature lead to large differences in amount of nitrogen-solid solution.

After studying the relationship between the Cr content in alloy and the amount of nitrogen-solid solution therewith, it was found out that among Fe—XCr-2Mo series alloys, the most suitable alloy for obtaining an austenite single-phase structure through the rapid cooling (S7) after the nitrogen absorption treatment (S8) is Fe-20Cr-2Mo in the present experiments, and 20 mass % or more Cr content is even preferable; it is necessary to increase the Cr content in the alloys in order to shorten the processing time of the nitrogen absorption treatment (S8); and that long hours of treatment needs to be carried out at such a temperature that does not allow CrN or Cr2N to precipitate in order to have the alloys austenite-structured efficiently, while keeping the Cr content low.

Further, it was revealed that in the case of Fe-8Cr-2Mo alloy and Fe-12Cr-2Mo alloy of which the Cr contents are low, amount of nitrogen-solid solution was only about 0.3% even after the long hours of the nitrogen absorption treatment (S8); and in the case of Fe-13Cr-2Mo alloy, amount of nitrogen-solid solution was only about 0.5% at maximum even after the long hours of the nitrogen absorption treatment (S8).

Accordingly, it turned out to be extremely difficult to have these alloys austenite-structured completely with nitrogen only. In the experiments, austenite and martensite were identified in the Fe-16Cr-2Mo alloy with which 0.6% or more N formed a solid solution, which is presumably because Fe-16Cr-2Mo alloy could not allow enough nitrogen for fully stabilizing austenite to form a solid solution therewith, and thus part of austenite was subjected to martensitic transformation at the time of the cooling step (S9).

From the result of the experiments, it was confirmed that the more Cr content the sample material contains, the more nitrogen can form a solid solution. If the Cr content in the alloys is increased, however, it is necessary to allow about 1% or more N to form a solid solution in order to maintain an austenite single-phase structure. It was found out that with that amount of nitrogen-solid solution, the Cr content in the alloys that can maintain the austenite single-phase structure up to room temperature was 24% at maximum; on the other hand, in the alloys of which the Cr content is less than 18%, martensite is formed by the nitrogen absorption treatment (S8), and thus mechanical (kinetic) properties are significantly reduced.

From the above observations, it was found out that the most suitable Cr content in the alloys to maintain the austenite single-phase structure up to a room temperature and to control martensitic phase transformation from austenite at the time of the cooling step (S9) after the nitrogen absorption treatment step (S8) is in a range of from 20 mass % and 24 mass %. Although the most suitable Cr content is in that range, the present invention proposes a range of from 18 mass % to 24 mass % since the object of the invention can still be achieved if the Cr content is 18% or more.

Moreover, there was noted some tendency that maximum tensile strength, breaking elongation, and section reduction rate increase as the Cr content in the alloys increase. Specifically, tensile characteristics were improved in the alloys containing 16% or more Cr content. This is presumably attributed to the fact that weakening by martensite caused early fracture of low Cr content alloys, leading to reduced tensile characteristics, since the formation of martensite as a fragile structure was found in the alloys containing less than 16% Cr content.

Although the amount of nitrogen-solid solution increases as the amount of Cr contained in the alloys increases, an austenite single-phase structure could not be obtained in the alloys having less than 16% Cr content through the solid-phase nitrogen absorption. Further, when the alloys having less than 16% Cr content were subjected to solid-phase nitrogen absorption treatment, mechanical (kinetic) characteristics were significantly reduced due to martensite being formed irrespective of processing hours. Further, the most suitable Cr content to obtain the austenite single-phase structure by the rapid cooling after the solid-phase nitrogen absorption treatment was not less than 20% but not more than 24%, and the Cr content in the alloys needs to be increased in order to shorten the processing time.

As is discussed in the above, the Cr content in ferritic stainless steel products and austenitized products should be 18 to 24% by mass, preferably 20 to 24% by mass, which may further contain 0 to 4%, preferably 0.5 to 3% by mass of Nb, and 0 to 4%, preferably 0.5 to 3% by mass of Cu, respectively. The addition of Nb and Cu makes contributions to improving corrosion resistance, weldability and formability, etc.

As described above, the reduction temperature for the preliminary reduction treatment (S4) should be 800 to 1000 degrees C., preferably 950 to 1000 degrees C. This is because the reduction temperature less than 800 degrees C. not only makes it difficult to fully remove the surface oxidization film that disturbs nitrogen diffusion, but also facilitates the production of precipitates that adversely affects corrosion resistance, strength, toughness, and processability, while the reduction temperature higher than 1000 degrees C. not only makes it easy for Cr that contributes to improving corrosion resistance to evaporate but facilitates reducing corrosion resistance, strength, toughness, etc. caused by the grain coarsening.

Further, the processing temperature for the nitrogen absorption treatment (S8) should be 1000 to 1200 degrees C., preferably 1150 to 1200 degrees C. This is because the processing temperature less than 1000 degrees C. makes it difficult to effectively diffuse nitrogen in the nitrogen absorption treatment, while the processing temperature higher than 1200 degrees C. reduces corrosion resistance, strength, toughness, etc. due to the grain coarsening.

Furthermore, the reduction temperature for the post reduction treatment (S12) should be 800 to 1000 degrees C., preferably 950 to 1000 degrees C. This is because the reduction temperature less than 800 degrees C. not only makes it difficult to obtain sufficient luminance by removing the surface oxidization film, but also facilitates the production of precipitates during the processing that adversely affects corrosion resistance, strength, toughness, and processability, while the reduction temperature higher than 1000 degrees C. not only makes it easy for Cr that contributes to improving corrosion resistance to evaporate but facilitates reducing corrosion resistance, strength, toughness, etc. caused by the grain coarsening.

In addition, it is desirable to perform the cold rolling step (S6) at least once. Alternatively, the cold rolling step (S6) in the combined rolling and nitrogen absorption treatment step" may be replaced by hot rolling step (S6). In the case of employing the hot rolling step (S6), such hot rolling step (S6) may use equipment including a load lock mechanism. Oxidation of the plate materials can be prevented by performing the hot rolling step (S6) in a vacuum chamber as a load lock chamber. The hot rolling temperature for the hot rolling step (S6) should be 800 to 1000 degrees C., preferably 900 to 1100 degrees C. This is because the hot rolling temperature less than 800 degrees C. may cause defects such as cracks at the time of rolling due to insufficient heating, while the rolling temperature higher than 1000 degrees C. facilitates producing defective surface properties such as cracks and wrinkles due to the grain coarsening occurring at the time of the rolling step.

Incidentally, the present invention should not be limited to the foregoing embodiments, but may be modified within the scope of the invention.

For example, although reduction treatment is employed as a surface oxide film removing step in the foregoing embodiments, cleaning by diluted fluorinated acid or mechanical grinding may also be employed. It should be noted that various other methods may be employed as long as they can clean a surface by removing oxide films in order to allow the subsequent nitrogen absorption to be carried out smoothly. Moreover, although the batch electric furnace is employed in the foregoing embodiments, a muffle type continuous kiln or furnace may also be used. Furthermore, various kinds of reduction gas may be used except hydrogen gas.

What is claimed:

1. A method for manufacturing a nickel-free stainless steel product from a nickel-free ferritic stainless steel material, with a part thereof being austenitized, the method comprising the steps of:

cold-rolling said nickel-free ferritic stainless steel material containing 18 to 24% by mass of Cr and 0 to 4% by mass of Mo;

subjecting said nickel-free ferritic stainless steel material to a nitrogen absorption treatment to allow said nickel-free ferritic stainless steel material to contain 0.3 to 1.5% by mass of N;

austenitizing a part of said nickel-free ferritic stainless steel material; and removing, with a reduction treatment, a surface oxide film in a mixed gas of an inert gas and a reductive gas prior to, or after, said nitrogen absorption treatment.

2. The method for manufacturing a stainless steel product according to claim 1, wherein the reduction treatment prior to said nitrogen absorption treatment is carried out in a mixed gas of an inert gas and a reducing gas at 800 to 1000 degrees C., said nitrogen absorption treatment is carried out under the nitrogen gas atmosphere at 1000 to 1200 degrees C., and the reduction treatment after said nitrogen absorption treatment is carried out under the reducing gas atmosphere at 800 to 1000 degrees C., respectively.

3. A method for manufacturing a nickel-free stainless steel product from a nickel-free ferritic stainless steel material, with a whole part thereof being austenitized, the method comprising the steps of:

cold-rolling said nickel-free ferritic stainless steel material containing 18 to 24% by mass of Cr and 0 to 4% by mass of Mo;

subjecting said nickel-free ferritic stainless steel material to a nitrogen absorption treatment to allow said nickel-free ferritic stainless steel material to contain 0.3 to 1.5% by mass of N;

austenitizing a whole part of said nickel-free ferritic stainless steel material completely; and removing, with a reduction treatment, a surface oxide film in a mixed gas of an inert gas and a reductive gas prior to, or after, said nitrogen absorption treatment.

4. The method for manufacturing a stainless steel product according to claim 3, wherein the reduction treatment prior to said nitrogen absorption treatment is carried out in a mixed gas of an inert gas and a reducing gas at 800 to 1000 degrees C., said nitrogen absorption treatment is carried out under the nitrogen gas atmosphere at 1000 to 1200 degrees C., and the reduction treatment after said nitrogen absorption treatment is carried out under the reducing gas atmosphere at 800 to 1000 degrees C., respectively.

5. The method for manufacturing a stainless steel product according to claim 3, wherein said cold-rolling step and said nitrogen absorption treatment are carried out in cycles, thereby austenitizing said nickel-free ferritic stainless steel material completely, and said reduction treatment is carried out prior to, or after said cycles.

* * * * *